US006805050B2

(12) United States Patent
Möhringer

(10) Patent No.: US 6,805,050 B2
(45) Date of Patent: Oct. 19, 2004

(54) PRINTING UNIT HAVING A DEVICE FOR REMOVING PARTICLES, AND A MACHINE FOR PROCESSING FLAT PRINTING MATERIALS HAVING SUCH A PRINTING UNIT

(75) Inventor: Markus Möhringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 71 days.

(21) Appl. No.: 10/108,114

(22) Filed: Mar. 27, 2002

(65) Prior Publication Data

US 2002/0139265 A1 Oct. 3, 2002

(30) Foreign Application Priority Data

Mar. 27, 2001 (DE) ..... 101 15 115

(51) Int. Cl.[7] ..... B41F 35/00; B41F 13/193

(52) U.S. Cl. ..... 101/425; 101/232; 101/420

(58) Field of Search ..... 15/303, 306.1, 15/309.2, 345; 101/425, 420, 232; 271/194, 195, 196

(56) References Cited

U.S. PATENT DOCUMENTS 3,775,806 A * 12/1973 Olbrant et al. ..... 15/309.1
3,828,998 A * 8/1974 Gross ..... 26/105
4,145,040 A * 3/1979 Huber ..... 271/276
4,207,998 A * 6/1980 Schmid ..... 226/95
4,838,982 A * 6/1989 Klaeser et al. ..... 156/520
5,913,268 A * 6/1999 Jackson et al. ..... 101/420
6,053,104 A 4/2000 Marks
6,125,754 A * 10/2000 Harris ..... 101/420

FOREIGN PATENT DOCUMENTS

DE 2 006 716 9/1970
DE 197 32 235 A1 1/1999
DE 199 03 887 A1 8/1999

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Gregory L. Mayback

(57) ABSTRACT

A printing unit for a machine for processing flat printing materials includes a feeding cylinder for loading the printing unit with the printing materials in a processing direction, and a device for removing particles adhering to the surface of the printing materials, the particle-removing device further including a blowing device for separating the particles from the printing materials without contact, and a suction device for discharging the separated particles, both the blowing device and the suction device being formed by blowing and suction chambers arranged within the feeding cylinder and having a fluidic connection to surroundings of a jacket surface of the feeding cylinder; a machine including the printing unit; and a feeding drum or cylinder of the printing unit.

20 Claims, 2 Drawing Sheets

2a
2b
2.1
2.2
2.3
2.4
2.5
3
3.1
3.2
3.3
3.4
3.5
3.6
4
4.1
4.2
4.3
4.4
4.5
4.6
4.7
4.8
4.9
4.10
4.11
4.12
4.13
4.14
4.15
4.16
5
5.1
5.2
5.3
5.4
5.5
7

2.3
2.32
2.33
6.5
6.7
6.8
6.9
6.10
6.11
7

PRINTING UNIT HAVING A DEVICE FOR REMOVING PARTICLES, AND A MACHINE FOR PROCESSING FLAT PRINTING MATERIALS HAVING SUCH A PRINTING UNIT

BACKGROUND OF THE INVENTION

Field of the Invention

The invention relates to a printing unit for a machine for processing flat printing materials, in particular a sheet-processing rotary printing machine, having a feeding cylinder for loading the printing unit with the printing materials in a processing direction, and a device for removing particles adhering to the surface of the printing materials, the particle-removing device comprising a blast or blowing device for separating the particles from the printing materials without contact, and a suction device for discharging the separated particles. The invention also relates to a machine for processing flat printing materials and to a machine equipped with at least one such printing unit, and also a feeder drum for such a printing unit.

For satisfactorily printing flat printing materials, such as sheets, for example, particles adhering to the surface of the sheets must be removed. The particles are, in particular, dust, and possibly separating agents which prevent adjacent sheets in a pile or stack from adhering to one another, in a case wherein printing is performed in a second pass through a printing machine.

In order to dispose of such particles, suction brushes connected upstream of a printing nip have become known heretofore, which loosen the particles mechanically from the surface of the printing materials and removes them by vacuum or negative pressure. As a rule, the suction brushes are be arranged between the impression cylinder and a feeding drum or cylinder that transfers the printing material to the impression cylinder, in order to feed the printing material dust-free to the printing nip. In order to obtain a printed a image that is free of transverse stripes, the image should have been completely printed out at the time of transfer to a transfer device, such as a transfer cylinder, for example.

Disadvantageously, when using suction brushes, there is, on the one hand, a possibility of mechanical damage occurring to the printing materials, it being possible, moreover, for paper particles loosened as a result of abrasion to lead to the formation of hickeys or lint, so that the suction brush requires continual installation and removal in order to clean it and remove the hickeys. This applies in particular to sensitive printing materials and to repeated passes or throughput, respectively, during multicolor printing. On the other hand, the suction brush requires additional space in the overall construction space of the printing unit, which is limited in any case, so that the feeding drum has to be arranged at a relatively great distance from the printing nip, which results in the printing material, for example, transferred from a pregripper to the feeding drum and then to the impression cylinder, being deflected over large circumferential sections of the feeding drum and of the impression cylinder. In the case of relatively stiff printing materials, in particular, this leads to scratching and/or marking thereof. Furthermore, because of the space required for the suction brush arranged between the feeding drum and the printing nip, for a given inclination and output height of a feeding table providing the printing materials to the pregripper, guidance of the printing material on the feeding table so as to be tangential to the feeding drum is not possible, so that, in particular in the case of thin printing materials, as the latter are transferred to the feeding drum, there is a risk of forming an inlet corrugation, by the fact that the printing material, which is gripped at the leading edge thereof by the pregripper, is bent upwardly in a direction towards the feeding drum at the point of contact with the feeding drum. Otherwise, it would be necessary for a feeding table of given output height, from which the printing material is transferred to the feeding drum by the pregripper, to be built quite long due to the feeding drum being arranged relatively far below the impression cylinder, which would be complicated from a construction standpoint and costly.

The published German Patent Document DE 199 03 887 A1 describes a printing machine having a first printing unit for printing the front side of sheets and a second printing unit for printing the rear side. Both printing units are equipped with devices for cleaning the sheets to be printed, the cleaning devices being buildable, on the one hand, by suction brushes, and on the other hand, by non-contacting or contact-free devices, such as blowing-air or blast, suction or electrostatic devices. The disadvantages mentioned hereinabove result from the requirement for additional space demanded by the respective cleaning device.

SUMMARY OF THE INVENTION

It is accordingly an object of the invention to provide a printing unit with a device for removing particles, as described in the introduction hereto, in a simple and cost-effective manner and wherein the space required for the device for removing particles, which adhere to the surface of the printing material, is minimized. It is, furthermore, an object of the invention to provide an accordingly improved machine for processing flat printing materials equipped with such a printing unit, and to provide an improved feeding cylinder for such a printing unit.

With the foregoing and other objects in view, there is provided, in accordance with one aspect of the invention, a printing unit for a machine for processing flat printing materials, comprising a feeding cylinder for loading the printing unit with the printing materials in a processing direction, and a device for removing particles adhering to the surface of the printing materials, the particle-removing device further comprising a blowing device for separating the particles from the printing materials without contact, and a suction device for discharging the separated particles, both the blowing device and the suction device being formed by blowing and suction chambers arranged within the feeding An cylinder and having a fluidic connection to surroundings of a By jacket surface of the feeding cylinder.

In accordance with another feature of the invention, both the blowing chamber and the suction chamber extend at least approximately over the entire width of the feeding cylinder.

In accordance with a further feature of the invention, both the blowing chamber and the suction chamber are arranged fixed against rotation.

In accordance with an added feature of the invention, the printing unit further comprises lines received in the feeding cylinder at least approximately centrally with respect to the feeding cylinder, via which both the blowing chamber and the suction chamber are actable upon by positive and negative pressure, respectively.

In accordance with an additional feature of the invention, the blowing chamber is arranged upstream of the suction chamber with respect to the processing direction.

In accordance with yet another feature of the invention, the suction chamber directly adjoins the blowing chamber.

In accordance with yet a further feature of the invention, the suction chamber is connected to a larger section of the jacket surface of the feeding cylinder than is the blowing chamber.

In accordance with yet an added feature of the invention, the jacket surface of the feeding cylinder connected to the suction chamber extends over a sector angle between 30° and 150°.

In accordance with yet an additional feature of the invention, the sector angle is between 60° and 120°.

In accordance with still another feature of the invention, the jacket surface of the feeding cylinder connected to the blowing chamber extends over a sector angle between 1° and 20°.

In accordance with still a further feature of the invention, the sector angle is between 1° and 10°.

In accordance with still an added feature of the invention, the feeding cylinder forms a hollow cylinder having a multiplicity of boreholes extending through the jacket surface thereof.

In accordance with still an additional feature of the invention, the printing unit further comprises thin webs formed in the jacket surface of the feeding cylinder for carrying the printing materials.

In accordance with another feature of the invention, the thin webs are arranged at least approximately in the circumferential direction of the feeding cylinder.

In accordance with a further feature of the invention, at most 10% of the jacket surface of the feeding cylinder is occupied by the thin webs.

In accordance with an added feature of the invention, the percentage is at most 5%.

In accordance with an additional feature of the invention, the printing unit further comprises thin webs formed in the jacket surface of the feeding cylinder for carrying the printing materials, the boreholes and the thin webs following one another alternately in axial direction of the feeding cylinder.

In accordance with yet another feature of the invention, the printing unit further comprises a blowing air bar arranged at least approximately parallel to the axis of the feeding cylinder located downstream of the feeding cylinder with respect to the processing direction.

In accordance with yet a further feature of the invention, the printing unit further comprises an impression cylinder, the blowing air bar being disposed in a wedge which, on one side, is bounded by the feeding cylinder and, on the other side, is bounded by a section of the impression cylinder carrying the printing materials.

In accordance with yet an added feature of the invention, the blowing air bar has nozzles aligned in the direction of the printing materials carried by the impression cylinder.

In accordance with yet an additional feature of the invention, the nozzles of the blowing air bar are directed towards areas of the printing material carried by the thin webs on the jacket surface of the feeding cylinder.

In accordance with another aspect of the invention, there is provided a machine for processing flat printing materials, having at least one printing unit comprising a feeding cylinder for loading the printing unit with the printing materials in a processing direction, and a device for removing particles adhering to the surface of the printing materials, the particle-removing device further comprising a blowing device for separating the particles from the printing materials without contact, and a suction device for discharging the separated particles, both the blowing device and the suction device being formed by blowing and suction chambers arranged within the feeding cylinder and having a fluidic connection to surroundings of a jacket surface of the feeding cylinder.

In accordance with a further feature of the invention, the processing machine is a sheet-processing rotary printing machine.

In accordance with a concomitant aspect of the invention, there is provided a feeding drum for a printing unit for processing flat printing materials, comprising a device for removing particles adhering to the surface of the printing materials, the particle-removing device further comprising a blowing device for separating the particles from the printing materials without contact, and a suction device for discharging the separated particles, both the blowing device and the suction device being formed by blowing and suction chambers arranged within the feeding drum and having a fluidic connection to surroundings of a jacket surface of the feeding drum.

According to the invention, in a printing unit of the type mentioned at the introduction hereto, the object of the invention is achieved by forming both the blowing device and the suction device from blowing and suction chambers which are arranged within the feeding cylinder and which have a fluidic connection to the surroundings of the outer or jacket surface of the feeding cylinder.

By the fact that the device for removing particles adhering to the surface of the printing material is integrated into the feeding cylinder in accordance with the invention, the particle-removing device needs no additional installation space, so that in the case of a compact construction of the printing unit, the feeding cylinder can be arranged to be higher with respect to the impression cylinder than in the prior art, in order firstly to permit deflection of the printing material around a relatively small circumferential section of the feeding cylinder, and secondly to permit guidance of the printing material on the feeding table so as to be tangential to the feeding cylinder, while avoiding the formation of an inlet corrugation. In this way, any impairment both of stiff and also of thin printing materials is reliably avoided and the sheet guidance is in no way impeded, a slimmer sheet run being possible, in particular because the printing material wraps to a lesser extent around the feeding cylinder. As a result of the printing material being attracted by suction, it is moreover smoothed onto the jacket surface of the feeding cylinder, so that sheet smoothing takes place before the printing material is introduced into the printing nip. In this way, possible changes in shape of the printing material in the following printing nip are minimized, and thus ghosting is prevented to the greatest possible extent.

In order to free the entire width of printing material from adhering particles, both the blowing chamber and the suction chamber expediently extend at least approximately over the entire length of the feeding cylinder.

In a preferred embodiment, provision is made for both the blowing chamber and the suction chamber to be fixed against rotation, so that, on the printing material transferred to the feeding cylinder by a pregripper, for example, there always acts a stationary blown air flow for the contact-free separation of the particles from the printing material, and the printing material is then likewise acted upon in a stationary region by vacuum, which discharges the separated particles.

Both the blowing chamber and the suction chamber can preferably be acted upon with positive and negative pressure, respectively, via lines arranged at least approximately centrally in relation to the feeding cylinder.

The blowing chamber is expediently arranged upstream of the suction chamber in the sheet conveying direction, in order firstly to separate without contact the particles adhering to the printing material and then to discharge them by vacuum while smoothing the printing material onto the feeding cylinder. In this regard, the suction chamber preferably adjoins the blowing chamber directly.

In an advantageous feature, the suction chamber is connected to a larger section of the jacket surface of the feeding cylinder than is the blowing chamber, the jacket surface of the feeding cylinder connected to the suction chamber preferably extending over a sector angle between 30° and 150°, in particular between 60° and 120°, and the outer surface of the feeding cylinder connected to the blowing chamber preferably extending over a sector angle between 1° and 20°, in particular between 1° and 10°.

The feeding cylinder is preferably formed by a hollow cylinder which has a large number of boreholes which pass through the jacket surface thereof, in order to connect this jacket surface at the respective circumferential section thereof to the blowing or the suction chamber.

The outer or jacket surface of the feeding cylinder is preferably equipped with thin webs which carry the printing material, so that the vacuum or blown air acts upon the largest possible surface area of the printing material. The webs are, for example, arranged at least approximately in the circumferential direction of the feeding cylinder, preferably at most 10%, in particular at most 5%, of the outer surface being occupied by the webs. The boreholes and the webs expediently follow one another alternately in the axial direction of the feeding cylinder.

In a further development of the invention, provision is made for a blowing air bar disposed at least approximately parallel to the axis of the feeding cylinder to be arranged downstream of the latter. This bar is preferably arranged in a wedge or wedge-shaped pocket which, on one side, is bounded by the feeding cylinder and, on the other side, is bounded by a section of the impression cylinder which carries the printing materials.

The blowing air bar serves for discharging the particles which may possibly remain on the printing material in the region of the webs, whereon it is in contact with the outer or jacket surface of the feeding cylinder, so that the particles which may possibly remain in these regions are distributed uniformly, and therefore no markings are produced on the printing material.

The blowing air bar has nozzles which are directed in particular in the direction of the printing materials, are expediently distributed over the entire length of the blowing air bar and are advantageously directed onto the areas of the printing materials carried by the thin webs on the outer or jacket surface of the feeding cylinder.

In addition, the invention also relates to a machine for processing flat printing materials, in particular a printing machine, which is equipped with at least one printing unit of the aforementioned type, and also a feeding cylinder for a printing unit of the aforementioned type.

Other features which are considered as characteristic for the invention are set forth in the appended claims.

Although the invention is illustrated and described herein as embodied in a printing unit with a device for removing particles, and a machine for processing flat printing materials and having such a printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
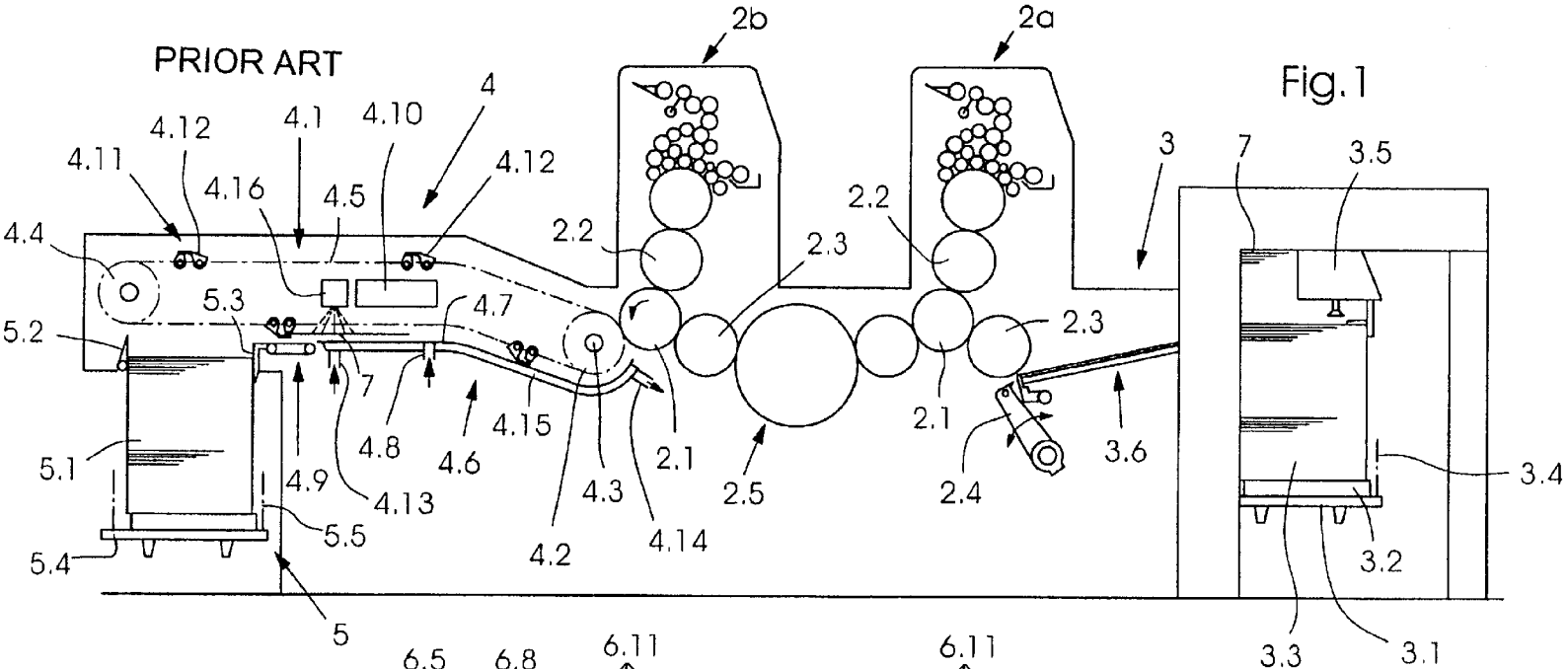
Fig.1 PRIOR ART
FIG. 1 is an overall diagrammatic side elevational view of an exemplary embodiment of a sheet-processing machine in the form of an offset printing machine constructed in accordance with the state of the prior art.

Referring now to the drawings and, first, particularly to FIG. 1 thereof, there is shown therein an overall diagrammatic view of a sheet-processing machine according to the prior art having a printing unit section 2*a*, 2*b*, a paper feeding device 3 in the form of a feeder, a delivery 4 with a chain conveyor 4.1 and a sheet stacking or pile station 5.1 to 5.5 arranged underneath an end region of the chain conveyor 4.1.

The paper feeding device 3 has a lifting platform 3.1 to accommodate a sheet pile or stack 3.3 formed of sheets 7 and set down on a stack or pile underlay 3.2, for example in the form of a pallet. In order to lift the lifting platform 3.1 stepwise in accordance with the removal of sheets 7 from the pile 3.3, a lifting mechanism operating with lifting chains 3.4 is provided. Located above the pile 3.3 is a separating unit 3.5 with lifting and dragging suckers for gripping the respective top sheet 7 of the pile 3.3 and for transferring that sheet 7 to a transport and alignment unit 3.6 which comprises suction belt conveyors and which aligns the sheets 7 at the respective leading edges and a lateral edge thereof in order to pass the sheets on.

The printing unit section 2*a*, 2*b*, which is of a rotary printing machine operating in the offset process in FIG. 1, has two printing units 2*a* and 2*b* in the illustrated exemplary embodiment and is consequently constructed for printing in two colors. In order to print other colors, another printing unit must be provided for each additional other color.

The printing units 2*a* and 2*b*, respectively, have an impression cylinder 2.1 and a blanket cylinder 2.2 interacting therewith, and a feeding cylinder 2.3 for transferring sheets to be printed in the respective printing unit to the respective impression cylinder 2.1, in the form of a feeding drum in the case of the printing unit 2*a*. In particular, the printing unit 2*a* is also equipped with a device 6 according to the invention, which is not illustrated in FIG. 1, for removing particles adhering to the surface of the sheets 7. The particle-removing device 6 is, however, described in detail further hereinbelow with reference to FIGS. 2 and 3 wherein it is illustrated in detail.

Arranged between the transport and alignment unit 3.6 and the feeding cylinder 2.3, which fulfills the function of the feeding drum in this construction, is a pregripper 2.4, which accepts a sheet 7 delivered and aligned by the transport and alignment unit 3.6, and transfers it to the feeding drum 2.3, which then transfers it to the impression cylinder 2.1 of the first printing unit 2*a*.

Between the printing units 2*a* and 2*b*, a sheet transfer device 2.5 is provided. If two printing units connected by such a sheet transfer device 2.5 print the same side of a sheet 7 with different colors, the sheets 7 then are transferred thereby unturned or unreversed; if two printing units connected by such a sheet transfer device 2.5, respectively, print a different side of a sheet 7, then the corresponding sheet transfer device 2.5 is constructed so that the sheets 7 are transferred to the succeeding printing unit after being turned or reversed.

For operation, for example, a drive with a belt drive driven by a motor and having an output gear is provided, which is connected (not illustrated) to a gear belonging to the sheet transfer device 2.5. Depending upon the configuration of the machine, the chain conveyor 4.1 and the paper feeding device 3 are operatively connected to the aforementioned drive or to separate drives.

The printed sheets 7 are transferred to the delivery 4. To this end, in the exemplary embodiment of FIG. 1, two drive sprockets 4.2 are operatively connected to the aforementioned drive. The chain conveyor 4.1 comprises two endless conveyor chains 4.5. The conveyor chains 4.5, respectively, run along a respective side wall of the delivery 4 and are guided, for example, by a non-illustrated chain guide. A respective one of the conveyor chains 4.5 is looped or wrapped round one of the two drive sprockets 4.2, which rotate synchronously and coaxially during operation, and in the exemplary embodiment at hand is guided over a deflection or guide sprocket 4.4 arranged downstream from the drive sprockets 4.2, as viewed with respect to the processing direction. In the example at hand, the drive sprockets 4.2 are seated on a common sprocket shaft 4.3. Between the two conveyor chains 4.5, there extend gripper systems 4.11, which are carried by the latter and have grippers 4.12, which pass through gaps provided between grippers on the impression cylinder 2.1 of the last and downstream printing unit 2*b* and, in this regard, accept a sheet 7 from the latter by gripping a gripper edge at the leading end of the sheet 7 immediately before the grippers arranged on the impression cylinder 2.1 are opened.

In the example at hand, the sheets 7 are transported by the lower chain run in FIG. 1. The section of the chain path through which the chain run passes is followed alongside by a sheet guide surface 4.7 which faces towards it and is formed on a sheet guide unit 4.6. Between the sheet guide surface 4.7 and the sheet 7, respectively, guided thereover, a supporting air pad is preferably formed. To this end, the sheet guide unit 4.6 is equipped with blowing or blast air nozzles 4.8 which open into the sheet guide surface 4.7, only one of the nozzles 4.8 being reproduced symbolically as representative of all thereof.

In order to prevent the printed sheets 7 from adhering or sticking to one another after they have been deposited in a pile or stack, a dryer 4.10 is provided on the path of the sheets 7 from the drive sprockets 4.2 to a sheet brake 4.9. Furthermore, a powdering device 4.16 connected downstream of the dryer 4.10 is provided. In order to avoid excessive heating of the sheet guide surface 4.7, a coolant circuit with an inlet nozzle 4.13, an outlet nozzle 4.14 and a coolant trough 4.15 arranged on the sheet guide surface 4.7 is also integrated into the sheet guide unit 4.6. The sheet brake 4.9 comprises a plurality of braking modules which, respectively, are formed by a suction belt conveyor, for example.

From the chain conveyor 4.1, the sheets 7 are transferred into the pile or stacking station 5, so that a pile 5.1 of sheets 7 is formed in the latter. In an upper holding region for the sheets 7, the pile or stacking station 5 has leading edge stops 5.2 and trailing edge stops 5.3 opposite thereto, by which the sheets 7 are aligned. Furthermore, the stacking or pile station 5 has a lifting mechanism, of which only a platform 5.4 carrying the pile 5.1, and lifting chains 5.5 carrying the platform and shown in phantom, are reproduced in FIG. 1.

The sheet-processing machine operates as follows:

A sheet 7 to be processed is removed from the pile 3.3 by the separating or singling unit 3.5 and transferred to the transport and alignment unit 3.6. As mentioned hereinbefore, the unit 3.6 transfers the sheet 7 to the pregripper 2.4, which in turn leads it to the feeding drum 2.3. The sheet 7 is then passed through the printing units 2*a* and 2*b* over the impression cylinders 2.1 and the sheet transfer device 2.5 and printed accordingly.

From the printing unit 2*b*, the sheet 7 is transferred to a gripper system 4.11 on the chain conveyor 4.1. To deposit the sheet 7 on the pile 5.1, the grippers 4.12 of the gripper system 4.11 open in order to transfer the sheet 7 to the sheet brake 4.9 when a trailing section of the sheet 7 is located over the sheet brake 4.9. The sheet brake 4.9 imparts to the sheet 7 a deposition speed, which is reduced in comparison with the processing speed and, after the deposition speed has been attained, releases the sheet 7, so that an appropriately decelerated sheet 7 ultimately strikes the leading edge stops 5.2 in the pile or stacking station 5 and, while being aligned on the leading edge stops 5.2 and on the trailing edge stops 5.3 located opposite thereto, together with preceding and/or following sheets 7, forms the pile or stack 5.1, which is lowered by the lifting chains 5.5 as the pile or stack grows.

Figure 2:
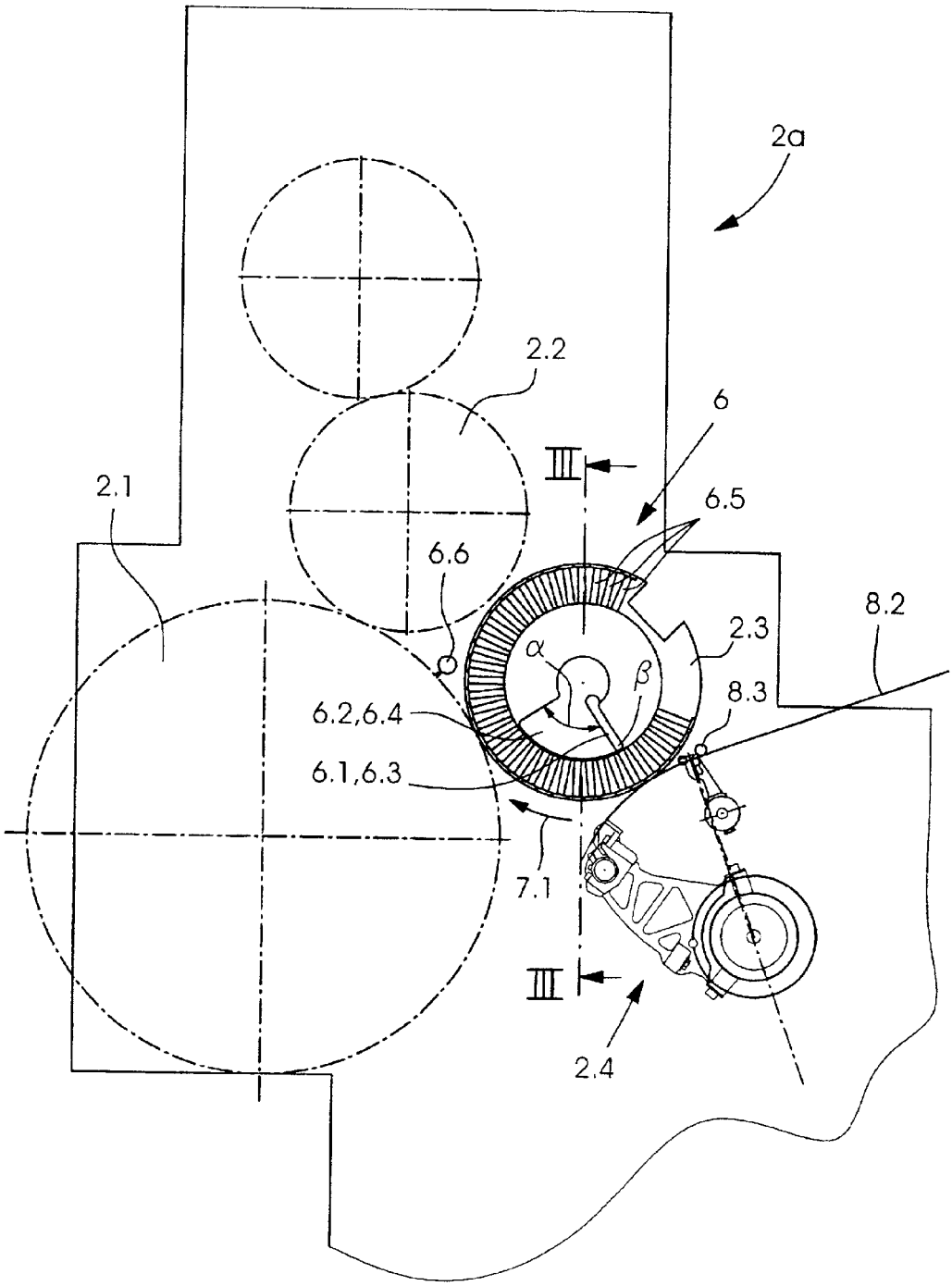
FIG. 2 is an enlarged fragmentary view of FIG. 1, showing a printing unit of the sheet-processing machine provided with improvements according to the invention.

The device 6 shown in FIG. 2 for removing particles adhering to the surface of the sheets to be printed comprises a blowing or blast device 6.1 for separating the particles from the sheets without contact, and a suction device 6.2 for discharging the particles, which are respectively formed by a blowing or blast chamber 6.3 and a suction chamber 6.4 arranged within the feeding cylinder 2.3 for transferring the sheets to the impression cylinder 2.1, and are, respectively, connected, via boreholes 6.5 (note FIG. 3) to the outer surface of the feeding cylinder 2.3, carrying the sheets. Both the blowing or blast chamber 6.3 and the suction chamber 6.4 are arranged fixed against rotation, the suction chamber 6.4 adjoining the blowing or blast chamber 6.3 directly in the sheet conveying direction 7.1. The suction chamber 6.4 is connected to a larger section of the outer surface of the feeding cylinder 2.3 than is the blowing or blast chamber 6.3, the outer surface of the feeding cylinder 2.3, which is connected to the suction chamber 6.4 in the exemplary embodiment shown, extending over a sector angle $\alpha$ of approximately 90°, while the outer cylindrical or jacket surface of the feeding cylinder 2.3, which is connected to the blowing or blast chamber 6.3, extends over a sector angle $\beta$ of about 5°.

The sheets guided by guide rollers 8.3 on a feeding table 8.2 belonging to the transport and alignment unit 3.6 and inclined with respect to the horizontal are transferred tangentially to the feeding drum 2.3 by the pregripper 2.4. The blowing or blast chamber 6.3 integrated into the feeding drum 2.3 is connected to a section of the outer jacket surface of the feeding drum 2.3 so that, when a sheet transferred from the pregripper 2.4 to the feeding drum 2.3 makes contact, it produces a blown or blast air flow upon the sheet, in order to separate adhering particles. The suction chamber 6.4 adjoining the blowing or blast chamber 6.3 extends at least approximately over a circumferential section of the feeding drum 2.3, that section being formed between the blowing or blast chamber 6.3 and a nip formed between the feeding drum 2.3 and the impression cylinder 2.1, in order to transfer the sheet to the impression cylinder 2.1 while smoothing it onto the feeding drum 2.3 and discharging or carrying away the loosened particles. The feeding drum 2.3 rotating in the sheet conveying direction 7.1 about the suction chamber 6.4 and the blowing or blast chamber 6.3, which are arranged fixed against rotation, is equipped with a large number of boreholes 6.5 which connect the chambers 6.3, 6.4 to the outer side of the outer or jacket surface of the feeding drum 2.3 (note also FIG. 3) and which, in the exemplary embodiment shown, extend over approximately 75% of the circumference of the feeding drum 2.3.

In order to remove and distribute particles, respectively, which may possibly remain in the vicinity of the contact surface of the sheet on the outer or jacket surface of the feeding drum 2.3, a blowing or blast air bar 6.6 extending parallel to the axis of the feeding drum 2.3 is arranged downstream of the latter and immediately upstream of the printing nip formed between the impression cylinder 2.1 and the blanket cylinder 2.2. The blowing or blast air bar 6.6 has non-illustrated nozzles which extend over the entire length thereof, are arranged in a direction towards the impression cylinder 2.1, and are expediently directed towards the contact surfaces of the sheets which are in contact with the outer cylindrical or jacket surface of the feeding drum 2.3.

Figure 3:
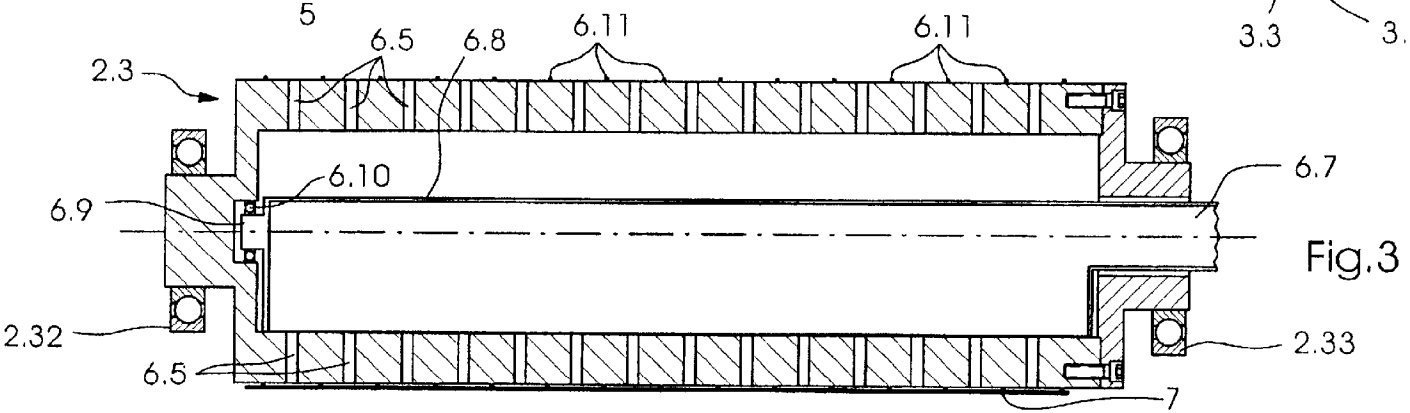
FIG. 3 is an enlarged fragmentary longitudinal sectional view of FIG. 2 taken along the line III—III in the direction of the arrows and showing the feeding cylinder of the printing unit according to FIG. 2 in the vicinity of a suction chamber.

As is apparent from FIG. 3, the feeding drum 2.3, constructed as a hollow cylinder, is rotatably mounted at the ends thereof by respective bearings 2.32 and 2.33. The suction chamber 6.4 arranged fixed against rotation within the feeding drum 2.3 extends at least approximately over the entire length of the feeding drum 2.3 and can be acted upon by vacuum via a line 6.7 arranged centrally in relation to the feeding drum 2.3, the suction chamber 6.4 being accommodated in a hollow shaft 6.8 which, at a side or end thereof directed away from the line 6.7, ends in a journal 6.9 which is used for mounting the feeding drum 2.3 by a further bearing 6.10. At the end thereof directed away from the journal 6.9, the hollow shaft 6.8 with the line 6.7 passes through the end wall of the hollow cylinder of the feeding drum 2.3. The blowing or blast chamber, which precedes the suction chamber 6.4 in the sheet conveying direction 7.1 but is not illustrated in FIG. 3 is arranged in a corresponding manner.

The suction chamber 6.4 and the blowing or blast chamber 6.3, respectively, are connected to the outer jacket surface of the rotating feeding drum 2.3 via a plurality of boreholes 6.5 which pass radially through the feeding drum 2.3, thin webs 6.11, which carry the sheet 7, being arranged in the circumferential direction between two axially adjacent boreholes 6.5, respectively. The webs 6.11 ensure a low contact surface of the sheet 7 with the outer surface of the feeding drum 2.3, and therefore ensure large-surface contact between the sheet and the vacuum or blowing air flow produced by the suction chamber 6.4 and the blowing or blast chamber 6.3, respectively. In the exemplary embodiment shown, for example, about 3% of the outer surface of the feeding drum 2.3 is occupied by the webs.

The device 6 for cleaning the sheets according to the invention makes use of the feeding drum 2.3 which is present in any case and therefore does not need any additional installation space, so that the feeding drum 2.3 can be arranged relatively high in relation to the impression cylinder 2.1, in particular in the immediate vicinity of the blanket cylinder 2.2, and thus the sheets are deflected around a very small circumferential section of the feeding drum 2.3 and thus, even in the case of stiff sheets, scratching or marking thereof is prevented. Furthermore, the tangent to the feeding drum 2.3 at the point of transfer of the sheets at least approximately coincides with the direction of the feeding table 8.2, so that the formation of an inlet corrugation is counteracted. The arrangement of the blanket cylinder 2.2 in the immediate vicinity of the feeding drum 2.3, which is possible with the equipment according to the invention, without the interposition of other cleaning devices, further ensures that the sheets are completely printed before being transferred to a following printing unit, i.e., during the transfer of the leading edge of the sheets from the impression cylinder 2.1 to a succeeding cylinder, the trailing sheet edge has already left the printing nip formed between the impression cylinder 2.1 and the blanket cylinder 2.2, so that so-called pick-up stripes in the printed image can be avoided.

I claim:

1. A printing unit for a machine for processing flat printing materials, comprising:

a feeding cylinder for loading the printing unit with the printing materials in a processing direction; and a particle-removing device for removing particles adhering to a surface of the printing materials, said particle-removing device including:

a blowing device for separating the particles from the printing materials without contact; and a suction device for discharging the separated particles;

both said blowing device and said suction device being formed by blowing and suction chambers disposed within said feeding cylinder and having a fluidic connection to surroundings of a jacket surface of said feeding cylinder, said blowing chamber being disposed upstream of said suction chamber with respect to the processing direction.

2. The printing unit according to claim 1, wherein both said blowing chamber and said suction chamber extend at least approximately over the entire width of said feeding cylinder.

3. The printing unit according to claim 1, wherein both said blowing chamber and said suction chamber are arranged fixed against rotation.

4. The printing unit according to claim 1, further comprising lines received in said feeding cylinder at least approximately centrally with respect to said feeding cylinder, via which both said blowing chamber and said suction chamber are actable upon by positive and negative pressure, respectively.

5. The printing unit according to claim 1, wherein said suction chamber directly adjoins said blowing chamber.

6. The printing unit according to claim 1, wherein said suction chamber is connected to a larger section of said jacket surface of said feeding cylinder than is said blowing chamber.

7. The printing unit according to claim 6, wherein said jacket surface of said feeding cylinder connected to said suction chamber extends over a sector angle between 30° and 150°.

8. The printing unit according to claim 7, wherein said sector angle is between 60° and 120°.

9. The printing unit according to claim 6, wherein said jacket surface of said feeding cylinder connected to said blowing chamber extends over a sector angle between 1° and 20°.

10. A The printing unit according to claim 9, wherein said sector angle is between 1° and 10°.

11. The printing unit according to claim 1, wherein said feeding cylinder forms a hollow cylinder having a multiplicity of boreholes extending through said jacket surface thereof.

12. The printing unit according to claims 11, further comprising thin webs formed in said jacket surface of said feeding cylinder for carrying the printing materials, said boreholes and said thin webs following one another alternately in axial direction of said feeding cylinder.

13. The printing unit according to claim 1, further comprising thin webs formed in said jacket surface of said feeding cylinder for carrying the printing materials.

14. The printing unit according to claim 13, wherein said thin webs are arranged at least approximately in circumferential direction of said feeding cylinder.

15. The printing unit according to claim 13, wherein at most 10% of said jacket surface of said feeding cylinder is occupied by said thin webs.

16. The printing unit according to claim 15, wherein said percentage is at most 5%.

17. The printing unit according to claim 1, further including a blowing air bar arranged at least approximately parallel to the axis of said feeding cylinder, said blowing air bar being located downstream of said feeding cylinder with respect to said processing direction.

18. The printing unit according to claim 17, further comprising an impression cylinder, said blowing air bar being disposed in a wedge which, on one side, is bounded by said feeding cylinder and, on the other side, is bounded by a section of said impression cylinder carrying the printing materials.

19. The printing unit according to claim 18, wherein said blowing air bar has nozzles aligned in the direction of the printing materials carried by said impression cylinder.

20. The printing unit according to claim 19, further comprising thin webs disposed in said jacket surface of said feeding cylinder for carrying the printing materials, said nozzles of said blowing air bar being directed towards areas of the printing material carried by said thin webs on said jacket surface of said feeding cylinder.

* * * * *